United States Patent [19]

Shah

[11] Patent Number: 4,630,536

[45] Date of Patent: Dec. 23, 1986

[54] HYDRAULIC DRIVE APPARATUS FOR DIE CARRIERS

[75] Inventor: Chandrakant K. Shah, Niles, Ill.

[73] Assignee: Avondale Industries, Inc., New York, N.Y.

[21] Appl. No.: 798,913

[22] Filed: Nov. 18, 1985

[51] Int. Cl.[4] ..... B30B 15/06

[52] U.S. Cl. ..... 100/229 R; 72/448; 100/918; 105/64.1

[58] Field of Search ..... 100/918, 221, 224, 229 R; 72/446, 448, 481; 105/63 R, 26 R, 64 R

[56] References Cited

U.S. PATENT DOCUMENTS

| | | | |
|---|---|---|---|
| 3,002,479 | 10/1961 | Johansen | 100/918 X |
| 3,111,100 | 11/1963 | Georgeff | 100/918 X |
| 3,134,350 | 5/1964 | Danly | 100/918 X |
| 3,207,065 | 9/1965 | Danly . | |
| 3,230,869 | 1/1966 | Wilkins . | |
| 3,306,185 | 2/1967 | Soman . | |
| 3,368,479 | 2/1968 | Gregorovich . | |
| 3,422,662 | 1/1969 | Geuss . | |
| 3,841,141 | 10/1974 | Rachwal . | |
| 3,841,142 | 10/1974 | Aisuta et al. . | |
| 4,408,521 | 10/1983 | Schelli et al. . | |
| 4,433,620 | 2/1984 | Kiyosawa . | |

OTHER PUBLICATIONS

"Cam Operated Deceleration Valves", brochure by Double A (Nov. 77).

*Primary Examiner*—Billy J. Wilhite

*Attorney, Agent, or Firm*—Leydig, Voit & Mayer

[57] ABSTRACT

A hydraulically driven die carrier for a power press, the carrier comprising a bolster for carrying a die; a set of wheels supporting the bolster for horizontal rolling movement to position the die horizontally; a separate hydraulic drive motor for each of the wheels; a plurality of hydraulic lift cylinders for moving the bolster vertically relative to the wheels; and a hydraulic control system for operating the hydraulic drive motors and lift cylinders for horizontal rolling and vertical movement of the die carrier, the control system including a supply pump having two separate outputs for providing separate sources of pressurized hydraulic fluid for the hydraulic drive motors and for the lift cylinders; a reservoir of hydraulic fluid connected to the pump; valve means for connecting and disconnecting the separate sources of hydraulic fluid and the respective drive motors and lift cylinders; and means for locking the lift cylinders in their raised positions while the cylinders are disconnected from the supply pump so that the hydraulic fluid in the line used to lift the carrier can be returned directly to the reservoir without being overheated as long as the carrier remains in its raised position. The hydraulic control system preferably also includes deceleration means for progressively restricting the flow of the hydraulic fluid through the drive motors as the carrier approaches the position where it is desired to stop the carrier, and then terminating the flow of the hydraulic fluid to stop the drive motors at the desired position.

11 Claims, 5 Drawing Figures

HYDRAULIC DRIVE APPARATUS FOR DIE CARRIERS

TECHNICAL FIELD

This invention relates generally to power presses and, more particularly, to a hydraulic drive system for die carriers for such presses.

BACKGROUND ART

As power presses have continued to increase in size and capability, the dies for use in such presses have accordingly increased both in size and weight. Much time and energy, hence cost, must be expended each time these dies are changed. It is, therefore, advantageous to provide moving and sliding bolsters or mechanically and electrically controlled carriers to facilitate quick die changes.

In the past, bolsters having sets of wheels driven by hydraulic motors have been extensively used in various applications to carry heavy dies. One such bolster has a set of wheels, a first motor for moving the bolster in and out of the press, and a second motor for raising and lowering the wheels to set the bolster down on the press bed. Another die-changing apparatus utilizes fixed, but vertically adjustable, support legs mechanized by hydraulic motors to lift and move the dies in and out of the press. In still another apparatus, a complicated pneumatic drive system is used for a wheeled, self-propelled bolster; in this system, two sets of four wheels are independently propelled by two pneumatic drive motors communicating with each other by a set of pilot-operated valves to provide the necessary transportation and support of a die assembly into and out of a press.

While these known die carriers are generally suited for their intended purposes, they are complicated in design due to long interconnecting shafts, couplings and clamping mechanisms and require highly skilled operating personnel and the exercise of great care to guard against operating errors and accidents.

DISCLOSURE OF THE INVENTION

It is, therefore, an object of the present invention to eliminate the above-mentioned disadvantages and provide a compact die carrier with a self-contained hydraulic system to facilitate quick die changes.

Another object of the present invention is to provide such a hydraulic system capable of efficiently utilizing available pressure sources and minimizing the wear-and-tear on the hydraulic motors.

A further object of the present invention is to provide a hydraulic drive system for a die carrier which requires only minimal effort from the operator by providing simple and easy operational requirements.

Still another object of the present invention is to provide such a hydraulic drive system which stops the die carrier at the desired positions without any abrupt shocks.

An additional object of the present invention is to provide a hydraulic drive system for a die carrier which ensures that the multiple drive motors share the total torque equally.

Objects and advantages of the invention will become apparent upon reference to the following detailed description, taken in conjunction with the accompanying drawings.

BEST MODE FOR CARRYING OUT THE INVENTION

Figure 1:
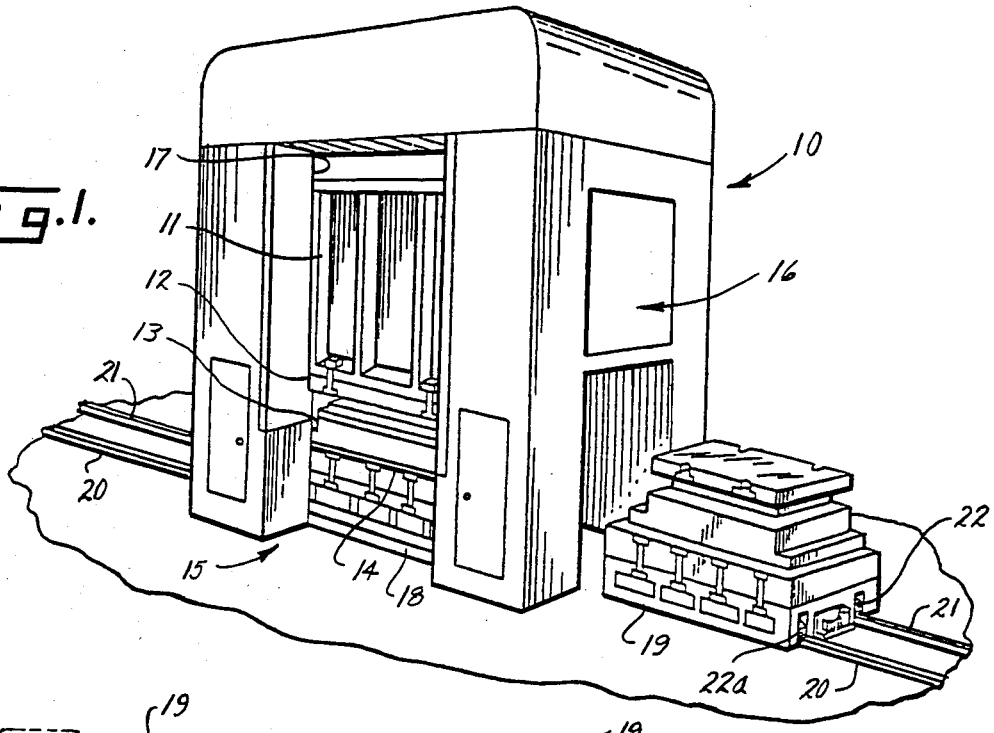
FIG. 1 is a perspective view of a power press utilizing a die carrier according to the present invention.

Referring to FIG. 1, there is shown a power press 10 having a slide 11 mounted for reciprocating movement along a vertical track and carrying a die 12 on the lower end thereof. A cooperating lower die 13 is mounted on a bolster 14 directly below the reciprocating slide 11. Workpieces are fed into the press through an opening 15 in the front of the press and positioned on the lower die 13 while the slide 11 is in a raised position. The workpiece is then worked by the next downward stroke of the press slide, after which the workpiece is raised off the lower die 13 and removed from the press through the front opening 15 or through a like opening in the rear of the press and along the same axis.

For the purpose of automatically changing the dies 12 and 13, a pair of like openings 16 and 17 are formed in opposite sides of the press to permit a pair of carriers 18 (shown within the press in FIG. 1) and 19 to have access to the interior of the press. The direction of movement of the carriers 18 and 19 is at right angles to the direction of movement of the workpieces so as to avoid interference with the automatic feed mechanisms that are commonly used to move the workpieces. The two carriers 18 and 19 enter the press from opposite sides so that whenever one of the carriers is in the press or in the process of entering the press, the other carrier can be used to remove the old set of dies from the press and receive a new set of dies for the next die change. The carriers 18 and 19 are guided to and from the press by two pairs of tracks 20 and 21 and are supported by a set of wheels **22*a*, 22*b*, 22*c* and 22*d***, each of which is driven by its own hydraulic motor.

Figure 2:
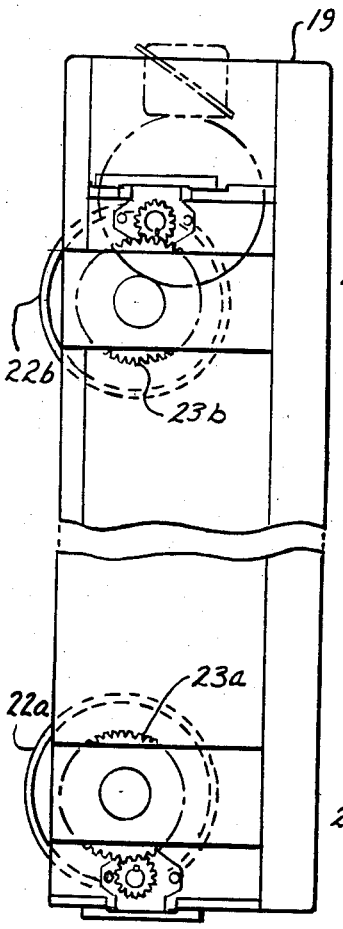
FIG. 2 is a fragmentary end elevation of the die carrier shown in FIG. 1.
Figure 3:
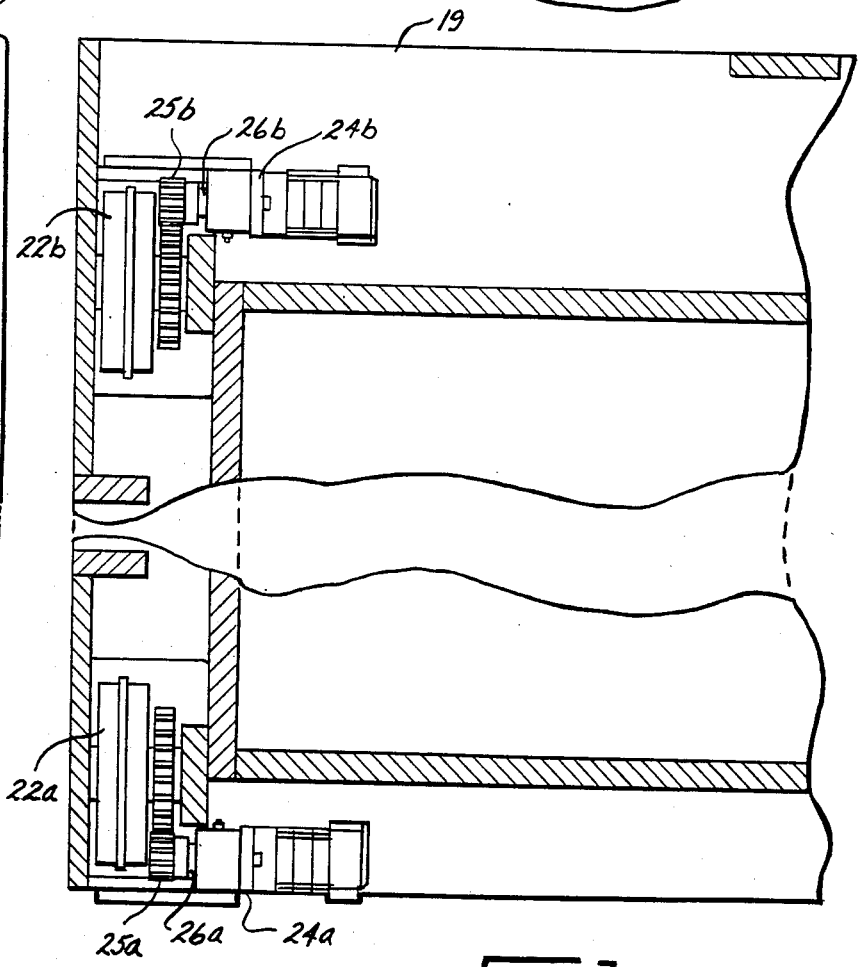
FIG. 3 is a fragmentary top plan view of the die carrier shown in FIG. 1.

FIGS. 2 and 3 are fragmentary side and plan views, respectively, of the die carrier 18 shown in FIG. 1. Only wheels **22*a* and 22*b* of the set of four wheels are illustrated, but it will be recognized that the other two wheels 22*c* and 22*d* have a similar construction. Attached to the wheels 22*a* and 22*b* are corresponding gears 23*a* and 23*b* driven by respective hydraulic motors 24*a* and 24*b* via gears 25*a* and 25*b* on the output shafts 26*a* and 26*b* of the motors. The hydraulic motors 24*a* and 24*b* are independently operated by hydraulic pressure, from a system which will be described in more detail below in connection with FIGS. 4 and 5. Because each wheel has its own drive motor, no connecting shafts, couplers or speed reducers are required. For lifting the bolsters off the press bed, a set of four hydraulic cylinders 27*a*, 27*b*, 27*c* and 27*d* on each bolster are operated by hydraulic pressure supplied from the same system that supplies the motors 24*a*–24*d***.

Figure 4:
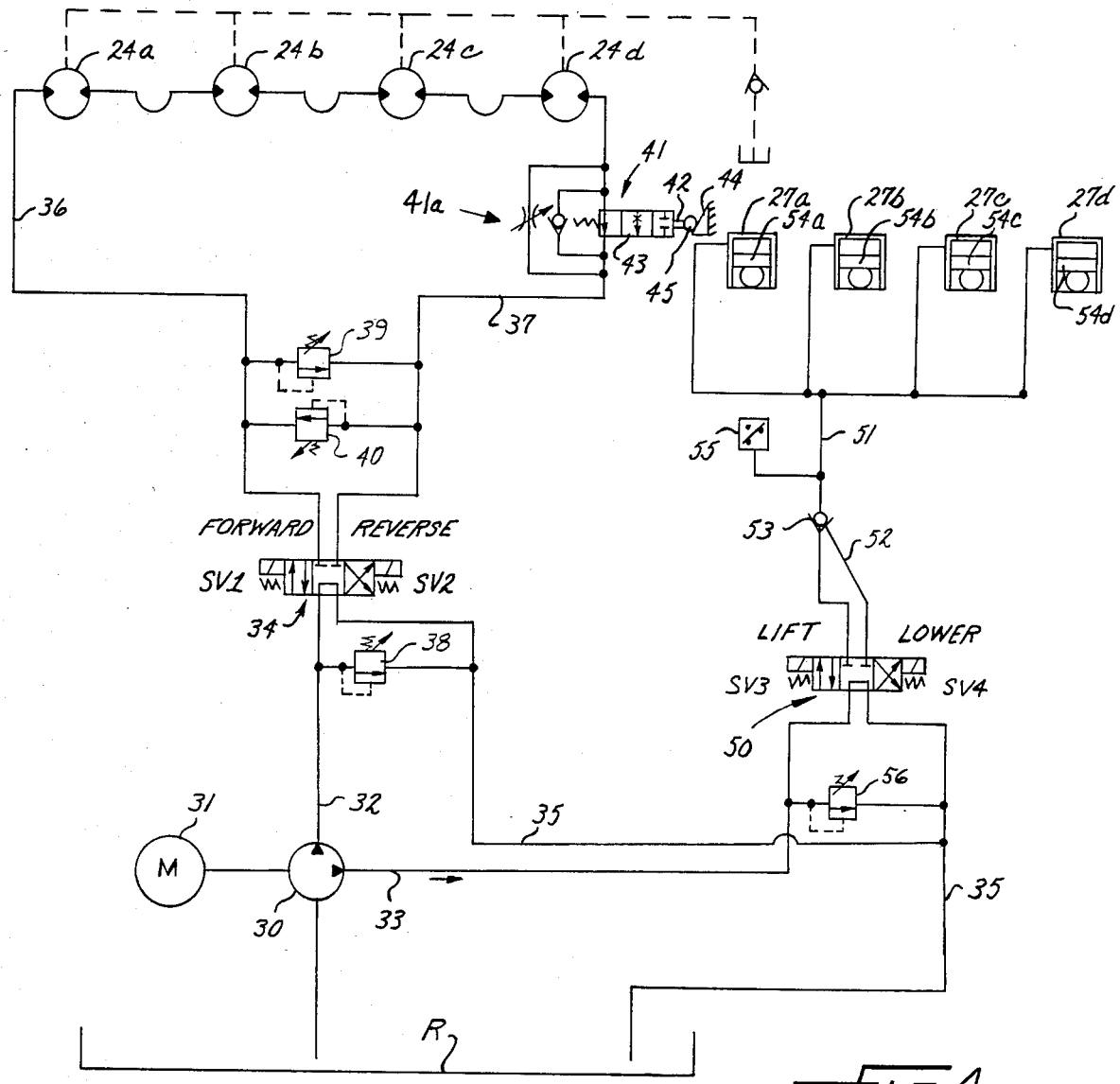
FIG. 4 is a schematic diagram of an embodiment of the hydraulic control system contained in the die carrier of FIGS. 2 and 3.
Figure 5:
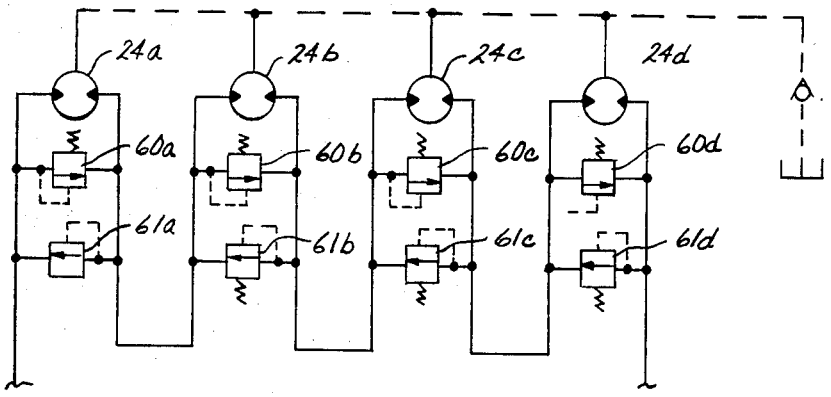
FIG. 5 is a schematic diagram of an optional modification for the hydraulic control system of FIG. 4.

Referring now to FIG. 4, the hydraulic system for the drive motors 24 and the lifting cylinders 27 includes a pump 30 driven by an electric motor 31. The pump 30 is an axial piston pump having four pistons, three of which are used to supply pressurized hydraulic fluid through an output line 32 to the four hydraulic drive motors 24*a*–24*d*. The fourth piston supplies pressurized hydraulic fluid to the four lift cylinders 27*a*–27*d* via an output line 33. The pump draws the hydraulic fluid from a reservoir R, and the fluid is returned to the same reservoir via the return line 35.

As can be seen in FIG. 4, the four drive motors 24*a*–24*d* are connected in series to ensure that maximum pressure is developed to deliver full torque. The supply of pressurized hydraulic fluid to the motors, as well as the direction of flow of the fluid through the motors, is controlled by a solenoid-operated valve 34 which controls the connections between the pump output line 32 and a return line 35 on one side of the valve, and a pair of lines 36 and 37 leading to opposite ends of the bank of drive motors 24*a*–24*d* on the other side of the valve. The valve 34 is normally held in its center, closed position by a pair of springs; in this position, which is the position illustrated in FIG. 4, the pump output line 32 is connected directly to the return line 35, so that fluid is not supplied to either of the motor lines 36 and 37. When the valve 34 is in this position, of course, the drive motors 24*a*–24*d* are off, i.e., their output shafts 26 are stationery.

To drive the die carrier in the forward direction, a solenoid SV1 is energized to move the valve 34 to a position where the pump output line 32 is connected to the line 36 leading to the motor 24*a*, and the return line 35 is connected to motor the 24*d* via the line 37. The pressurized hydraulic fluid from the pump output line 32 thus flows through the motors from left to right as viewed in FIG. 4, thereby driving the four wheels of the die carrier in a forward direction, i.e., into the press. To drive the die carrier in the reverse direction, a solenoid SV2 is energized to move the valve 34 to a position where the pump output line 32 is connected to the line 37 leading to the motor 24*d*, and the return line 35 is connected to the motor 24*a* via the line 36; this causes the pressurized hydraulic fluid from the pump output line 32 to flow through the four drive motors from right to left as viewed in FIG. 4, thereby driving the four wheels of the die carrier in the reverse direction, i.e., away from the press.

To insure that excessive pressure is not applied to the system components a relief valve 38 is connected between the pump output line 32 and the return line 35. This relief valve 38 is preset to open at a predetermined pressure, e.g., 2800 psi, to shunt the hydraulic fluid directly from the output line 32 to the return line 35, thereby preventing the pressure applied to the system components from rising above a safe level, i.e., the preselected pressure at which the relief valve 38 is set to open.

A pair of similar relief valves 39 and 40 are connected in parallel across the two hydraulic lines 36 and 37 leading to the drive motors 24*a*–24*d*. These valves conduct fluid in opposite directions so that the valve 39 serves as a relief valve when the motors are being driven in the forward direction by pressurized fluid in line 36, while the other valve 40 serves as a relief valve when the motors are being driven in the reverse direction by pressurized fluid in line 37. Both these valves 39 and 40 are preset to open at a predetermined pressure higher than that of the relief valve 38, e.g., 3000 psi. When the valve 34 shifts to its center position by deenergizing either the solenoid valve SV1 or the solenoid valve SV2, the carrier (which is still in motion) either pushes the oil from line 37 to line 36 (when SV1 is de-energized) or pushes the oil from line 36 to line 37 (when SV2 is de-energized). This provides braking action to the moving carrier.

In accordance with one important aspect of the present invention, deceleration means progressively restricts the flow of the hydraulic fluid through the drive motors as the carrier approaches the position where it is desired to stop the carrier, and then terminates the flow of the hydraulic fluid to stop the drive motors at the desired position. This hydraulic deceleration feature stops the die carrier in a smooth, shock-free manner which extends the life of the equipment and also reduces maintenance problems. In the illustrative embodiment, the deceleration function is performed by a cam-operated deceleration valve 41 in line 37. This valve 41 has a cam-operated plunger 45 which moves the valve spool 43 between a fully open position (illustrated in FIG. 4) and a fully closed position. As the valve spool 43 is moved between the fully open and fully closed positions, it gradually restricts the valve orifice, thereby reducing the flow rate of the hydraulic fluid and decreasing the speed of the drive motors 24*a*–24*d*. When the valve spool reaches its fully closed position, the flow of hydraulic fluid is stopped entirely, thereby stopping the drive motors 24*a*–24*d*.

To actuate the valve plunger 45, a cam 44 is mounted adjacent the tracks 20, 21 so that the plunger 45 engages the cam 44 as the carrier approaches the desired stop position. The cam surface which engages the follower on the plunger 45 gradually depresses the plunger to produce the desired rate of deceleration, and to move the plunger to the fully closed position when the carrier reaches the desired stop position.

During deceleration the flow of oil from the pump 30 is not changed, but the deceleration valve 41 reduces the amount of oil flowing through the drive motors 24*a*–24*d*. The remaining flow is diverted to the resevoir by the relief valve 38.

A metering valve 41*a* is connected across the deceleration valve. When the valve plunger is fully depressed, the deceleration valve 41 is closed, and oil from motor 24*d* can flow thru the valve 41*a*. The amount of oil that can flow through the valve 41*a* depends on the amount of opening of the valve, and thus the carrier can be decelerated to stop or to slow velocity.

In order to actuate the lift cylinders 27*a*–27*d* to raise the die carrier, the pump output line 33 is connected to the four parallel lift cylinders by a solenoid-operated valve 50. This valve 50 controls the connections between the pump output line 33 and the return line 35 on one side of the valve, and a line 51 leading to the lift cylinders 27*a*–27*d* and a pilot line 52 leading to a check valve 53 in line 51 on the other side of the valve. The valve 50 is normally held in its center, position by a pair of springs; in this position, which is the position illustrated in FIG. 4, the valve connects the pump output line 33 directly to the return line 35.

To lift the four cylinders 27*a*–27*d*, a solenoid SV3 is energized to move the valve 50 to a position where the pump output line 33 is connected to the cylinders 27*a*–27*d* via line 51 and the check valve 53. As illustrated in FIG. 4, the pressurized fluid enters the space between the top of each cylinder 27 and a stationary piston 54 connected to one of the wheels 22. As this pressure raises the cylinders 27, the wheels transmit the entire load of the carrier to the tracks and the press bed.

The lift cylinders are locked in their raised positions and disconnected from the supply pump so that the hydraulic fluid in the line used to lift the carrier can be returned directly to the reservoir without being overheated, as long as the carrier remains in its raised position. Thus, in the illustrative system shown in FIG. 4, the pressure in the lift cylinders 27*a*–27*d* trips a pressure switch 55 to de-energize the solenoid SV3 when the carrier has been lifted to its desired raised position. De-energization of the solenoid SV3 causes the valve 50 to return to its center, closed position, which in turn causes the check valve 53 to close because of the pressure produced in the cylinders 27*a*–27*d*, and thus in the line 51, by the weight of the carrier. Thus, the lift cylinders 27*a*–27*d* are locked in their raised positions by the closure of the check valve 53, and the hydraulic fluid from the pump output line 33 is shunted through the valve 50 directly into the return line 35, thereby preventing heating of this portion of the hydraulic fluid due to pressure build-up in the lift cylinders.

When it is desired to lower the carrier, after it has reached its destination, a solenoid SV4 is energized to move the valve 50 to a position where the pressurized fluid in the output line 33 is conducted into the pilot line 52 to open the check valve 53. The weight of the carrier then lowers the pistons in the lift cylinders 27*a*–27*d*, forcing the hydraulic fluid out of the cylinders and through the line 51 and the valve 50 into the return line 35.

To insure that excessive pressure is not applied to the valve 50 or the lift cylinders 27–27D, a relief valve 56 is connected between the pump output line 33 and the return line 35. This relief valve 56 is preset to open at a predetermined pressure, e.g., 2400 psi, to shunt the hydraulic fluid directly from the output line 33 to the return line 35, thereby preventing the pressure applied to the valve 50 and the lift cylinders 27*a*–27*d* from rising above the preselected pressure at which the relief valve 56 is set to open.

As a further feature of the invention, relief valves are connected across each of the hydraulic drive motors 24*a*–24*d* to prevent one motor from delivering full load torque. During everyday operation of a die carrier, it is possible for only one of the motors to become obstructed and deliver torque corresponding to the pressure setting of relief valve 38. This would not be desirable since one wheel will do all the work while the other three wheels will slip, and the carrier may not move properly. Thus, in the modified arrangement illustrated in FIG. 5, a pair of relief valves 60 and 61 are connected in parallel across each of the motors 24. As in the case of the relief valves 39 and 40 described previously, the valves 60 and 61 conduct hydraulic fluid in opposite directions, so that the valve 60 serves as a relief valve when the motors are being driven in the forward direction, and the valve 61 serves as a relief valve when the motors are being driven in the reverse direction. Each of these valves is preset to open at a relatively low pressure level, e.g., 650 psi, to prevent any one of the drive motors from delivering more than approximately ¼ of the total torque delivered by the four motors.

The entire hydraulic system described above is preferably contained within the die carrier so that no electrical or hydraulic connections are required to off-board equipment.

I claim:

1. A hydraulically driven die carrier for a power press, said carrier comprising:

a bolster for carrying a die;

a set of wheels supporting said bolster for horizontal rolling movement to position said die horizontally;

a separate hydraulic drive motor for each of said wheels;

a plurality of hydraulic lift cylinders for moving said bolster vertically relative to said wheels; and a hydraulic control system for operating said hydraulic drive motors and lift cylinders for horizontal rolling and vertical movement of said die carrier, said control system including:

a supply pump having two separate outputs for providing separate sources of pressurized hydraulic fluid for said hydraulic drive motors and for said lift cylinders;

a reservoir of hydraulic fluid connected to said pump;

valve means for connecting and disconnecting said separate sources of hydraulic fluid and the respective drive motors and lift cylinders; and means for locking said lift cylinders in their raised positions while said cylinders are disconnected from said supply pump so that the hydraulic fluid in the line used to lift the carrier can be returned directly to the reservoir without being overheated as long as the carrier remains in its raised position.

2. The hydraulically driven die carrier of claim 1 wherein said valve means includes a solenoid-operated valve for connecting and disconnecting said lift cylinders and the source of pressurized hydraulic fluid for said cylinders, and said locking means includes a check valve connected between said solenoid-operated valve and said lift cylinders for retaining said hydraulic fluid in said lift cylinders when the cylinders are disconnected from said source of pressurized hydraulic fluid, thereby maintaining the cylinders in their fully raised positions; a pilot line connected to said check valve for opening the check valve to lower said lift cylinders by releasing hydraulic fluid from the cylinders; and means for supplying pressurized hydraulic fluid to said pilot line when it is desired to lower said lift cylinders.

3. The hydraulically driven die carrier of claim 2 wherein said means for supplying pressurized hydraulic fluid to said pilot line comprises a solenoid-operated valve for connecting said pilot line to said source of pressurized hydraulic fluid for said lift cylinders.

4. The hydraulically driven die carrier of claim 1 which includes a solenoid-operated valve for connecting and disconnecting said lift cylinders and the source of pressurized hydraulic fluid for said cylinders, and a pressure-actuated electrical switch connected to said solenoid-operated valve for disconnecting said lift cylinders from said source of pressurized hydraulic fluid in response to a preselected pressure level in said lift cylinders, said pressure level representing the fully raised positions of said cylinders.

5. The hydraulically driven die carrier of claim 1 in which said drive motors are connected hydraulically in series.

6. The hydraulically driven die carrier of claim 1 wherein said hydraulic control system includes deceleration means for progressively restricting the flow of said hydraulic fluid through said drive motors as the carrier approaches the position where it is desired to stop the carrier, and then terminating the flow of the hydraulic fluid to stop said drive motors at said desired position.

7. A hydraulically driven die carrier as set forth in claim 1 wherein said drive motors are connected in series, and relief valves are connected across each motor to ensure that said drive motors share the total torque equally.

8. A hydraulically driven die carrier for a power press, said carrier comprising:

a bolster for carrying a die;

a set of wheels supporting said bolster for horizontal rolling movement to position said die horizontally;

a separate hydraulic drive motor for each of said wheels;

a hydraulic control system for supplying pressurized hydraulic fluid to said drive motors for horizontal rolling movement of said die carrier, said control system including deceleration means for progressively restricting the flow of said hydraulic fluid through said drive motors as the carrier approaches the position where it is desired to stop the carrier, and then terminating the flow of the hydraulic fluid to stop said drive motors at said desired position.

9. The hydraulically driven die carrier of claim 8 wherein said deceleration means comprises a cam-operated deceleration valve mounted on the carrier.

10. The hydraulically drive die carrier of claim 9 which includes a track for the carrier and cam means adjacent said track for activating said deceleration valve as the carrier approaches a desired stop position.

11. A hydraulically driven die carrier of claim 8 which includes:

a plurality of hydraulic lift cylinders for moving said bolster vertically relative to said wheels; and wherein said hydraulic control system includes a supply pump having two separate outputs for providing separate sources of pressurized hydraulic fluid for said hydraulic drive motors and for said lift cylinders;

a reservoir of hydraulic fluid connected to said pump;

valve means for connecting and disconnecting said separate sources of hydraulic fluid and the respective drive motors and lift cylinders; and means for locking said lift cylinders in their raised positions while said cylinders are disconnected from said supply pump so that the hydraulic fluid in the line used to lift the carrier can be returned directly to the reservoir without being overheated as long as the carrier remains in its raised position.

* * * * *